US009834887B2

(12) United States Patent
White et al.

(10) Patent No.: US 9,834,887 B2
(45) Date of Patent: Dec. 5, 2017

(54) ADJUSTABLE FOIL APPARATUS FOR PAPER MAKING MACHINE

(71) Applicant: COLDWATER SEALS, INC., Atlanta, GA (US)

(72) Inventors: James D. White, Belchertown, MA (US); Karl Lemme, Blandford, MA (US)

(73) Assignee: COLDWATER SEALS, INC., Atlanta, GA (US)

( * ) Notice: Subject to any disclaimer, the term of this patent is extended or adjusted under 35 U.S.C. 154(b) by 0 days.

(21) Appl. No.: 15/091,108

(22) Filed: Apr. 5, 2016

(65) Prior Publication Data

US 2017/0022665 A1 Jan. 26, 2017

Related U.S. Application Data

(60) Provisional application No. 62/145,894, filed on Apr. 10, 2015.

(51) Int. Cl.
*D21F 1/00* (2006.01)
*D21F 1/48* (2006.01)

(52) U.S. Cl.
CPC ..... *D21F 1/009* (2013.01); *D21F 1/486* (2013.01)

(58) Field of Classification Search
CPC ..... D21F 1/486; D21F 1/009; D21F 1/00
USPC ..... 162/289
See application file for complete search history.

(56) References Cited

U.S. PATENT DOCUMENTS

| | | | | |
|---|---|---|---|---|
| 2,969,837 | A | 1/1961 | Reynar | |
| 4,140,573 | A | 2/1979 | Johnson | |
| 5,169,500 | A * | 12/1992 | Mejdell | D21F 1/486 162/352 |
| 5,660,689 | A | 8/1997 | Bartelmuss et al. | |
| 6,780,285 | B2 | 8/2004 | Leinonen et al. | |
| 7,005,039 | B2 | 2/2006 | Bartelmuss et al. | |
| RE43,679 | E | 9/2012 | Van Essen et al. | |
| 9,506,191 | B2 | 11/2016 | Erkelenz et al. | |
| 9,650,743 | B2 | 5/2017 | Erkelenz et al. | |
| 9,708,768 | B2 | 7/2017 | Erkelenz et al. | |
| 2011/0074126 | A1* | 3/2011 | Wang | A63B 55/00 280/47.371 |
| 2013/0328272 | A1 | 12/2013 | Honold | |
| 2014/0216676 | A1* | 8/2014 | Gauss | D21F 7/00 162/348 |
| 2016/0362836 | A1* | 12/2016 | White | D21F 1/486 |

* cited by examiner

*Primary Examiner* — Mark Halpern
(74) *Attorney, Agent, or Firm* — McClure, Qualey & Rodack, LLP

(57) ABSTRACT

An adjustable foil apparatus for use with a paper making machine includes an elongated upper assembly having a forming element positionable relative to a forming fabric of a paper making machine and an elongated base mountable to a paper making machine. The upper assembly being coupled to the base and movable relative thereto for adjusting an overall height of the foil apparatus, the forming element being configured for selective movement toward and away from the forming fabric of a paper making machine. The adjustable foil apparatus including an adjustment mechanism fixed to the base, the adjustment mechanism including a slide bar movable relative to the base along an axis of the base and configured to move the forming element relative to the base and toward and away from the forming fabric.

14 Claims, 16 Drawing Sheets

ADJUSTABLE FOIL APPARATUS FOR PAPER MAKING MACHINE

CROSS-REFERENCE TO REI.ATED APPLICATIONS

This application claims the benefit under 35 U.S.C. §119 (e) of U.S. Provisional Application No. 62/145,894 filed Apr. 10, 2015, the entire disclosure of which is hereby incorporated by reference.

FIELD OF THE INVENTION

The present disclosure relates generally to a foil apparatus for a paper making machine and method of use of a foil apparatus. More particularly, the disclosure relates to an adjustable foil apparatus having a forming element that is movable toward and away from a forming fabric of a paper making machine during a forming process, and method of use of the foil apparatus.

BACKGROUND OF THE INVENTION

The statements in this section merely provide background information related to the present disclosure and may not constitute prior art.

Paper mill slurry stock supplied to the forming fabric of a paper machine is made up of fibers and solids in an aqueous solution containing generally from about 99 to about 99.9 percent water. The aim of a paper maker is to mix the slurry stock thoroughly in the head box of a paper making machine so that the fibers will be uniformly dispersed. Despite this attempt, the fibers often tend to agglomerate in the head box and emerge from the slice in clumps or flocs and the slurry stock is deposited on the forming fabric in this condition. If these flocs or fibers remain undispersed, the finished paper will not be of uniform density.

The forming fabric, as used on typical paper making machines, is an open mesh belt of woven cloth. The warp and weft strands of the cloth may be a metal, for example bronze or stainless steel or a plastic material, for instance polyester in multifilament or monofilament form.

Several devices have been used to redistribute fibers in the slurry stock after it has been transferred to the forming fabric during a dewatering process.

U.S. Pat. No. 4,140,573 discloses the concept of forming surfaces positioned below the normal plane of a forming fabric. In the '573 patent a crude method for vertical adjustment is suggested in FIG. 6 however, this was never commercially produced, nor would it have been a practical method of adjustment while the machine was in operation as it would require a user to loosen one side of the of the adjustment mechanism, before movement of the forming surface would be possible from the opposite side of the machine. This suggested arrangement is not adaptable to existing support structures as the mechanism for vertical adjustment is part of the base of the forming element.

U.S. Pat. No. 5,660,689 teaches means for vertical adjustment of a forming element affixed above a vertically adjustable mount. This arrangement also includes a tilting feature not necessary to the objective, but requires structural components which add to the overall height of the assembly. Thus, the forming element disclosed in the '689 patent is not adaptable for use with currently used forming structures having a standard height.

Pat. No. U.S. RE43,679 E discloses a method to lower a forming element surface away from the forming fabric of a paper making machine using a foraminous surface that is vertically adjustable. The illustrated embodiment describes the adjustment as a pivoting means which lowers the forming surface at angle relative to the forming plane thus it is not truly vertical movement of the forming element. The disclosed pivoting means for lowering the forming element surface are constructed within the structure of the forming element. Thus, the foraminous surface disclosed is not adaptable for use with existing forming structures, and mounts therefor.

In U.S. Pat. No. 7,005,039 B2 a device utilizes a variety of small internal parts including wedge shaped parts disposed across a full width of a paper making machine to provide a height adjustment for a foil member. The internal parts are connected via a machine-width cross shaft. Overall height adjustability is limited to about 4 mm (0.1574") making it impractical for use where absolute disconnection from the forming fabric is required.

U.S. Pat. No. 6,780,285 B2 and U.S. Pat. No. 6,780,285 B2 teach devices that utilize air or hydraulic pressure to actuate and adjust the height of a forming element surface relative to a plane of the forming fabric in a paper making machine. These type of devices are not equipped for accurate positioning relative to the forming fabric, thus such devices are typically set to be either in contact with or completely out of contact with the forming fabric.

Each of the above-mentioned devices are used to reduce floccing in a paper making process however, none of the prior art devices are sufficiently adjustable to suit the changing variety of paper grades, weights and processing speeds currently delivered by a typical paper making machine. Accordingly, using the above-described foil blades, a paper maker is often tasked with continuously removing and replacing foil blades of varied specifications in an attempt to maintain high quality paper of various grades and made with differing processing speeds.

It is an object of the present teachings to provide an adjustable foil apparatus for a papermaking machine that overcomes the shortcomings of prior art foil devices.

SUMMARY OF THE INVENTION

This section provides a general summary of the disclosure and does provide a comprehensive description or include full scope or ail the features of the subject matter disclosed.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description, the appended claims and the following drawings. The drawings are for illustrative purposes only and are not intended to limit the scope of the present disclosure.

DETAILED DESCRIPTION OF EMBODIMENTS OF THE INVENTION

Detailed illustrative descriptions of example embodiments are disclosed herein. However, specific structural and functional details disclosed herein are merely representative for purposes of describing example embodiments. The example embodiments may be embodied in many alternate forms and should not be construed as limited to only the example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 1:
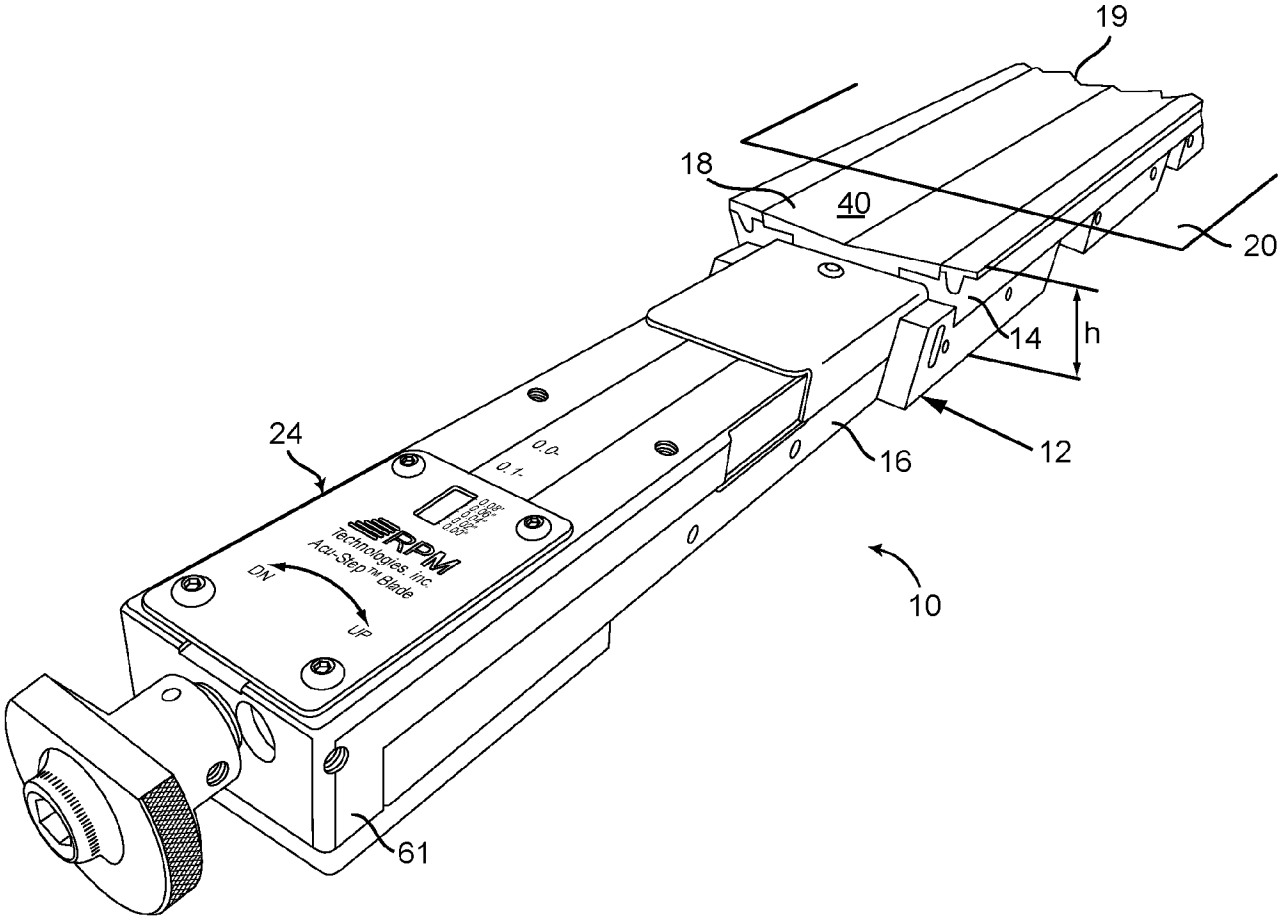
FIG. 1 is a partial perspective view of one embodiment of a foil apparatus in accordance with the present invention.

FIG. 1 is an illustration of one embodiment of an adjustable foil apparatus 10 according to the present invention. The foil apparatus 10 includes an elongated foil member 12 having an upper assembly 14 and a base 16. The upper assembly 14 includes a forming element 18 positionable below a forming fabric 20 of a paper making machine (not shown). FIG. 1 includes only a partial view of the foil apparatus 10 as denoted by the jagged line 19 shown in the figure; thus, an extended portion of the elongated foil member 12 is omitted from FIG. 1. Also, the forming fabric 20 is not shown in its entirety in FIG. 1.

Still referring to FIG. 1, the foil apparatus 10 includes an adjustment mechanism 24 coupled to the base 16 and configured to slidably move the upper assembly 14 relative to the base 16 thereby adjusting a height h of the foil apparatus 10 for moving the forming element 18 toward and away from the forming fabric 20 as discussed further hereinafter.

Figure 2:
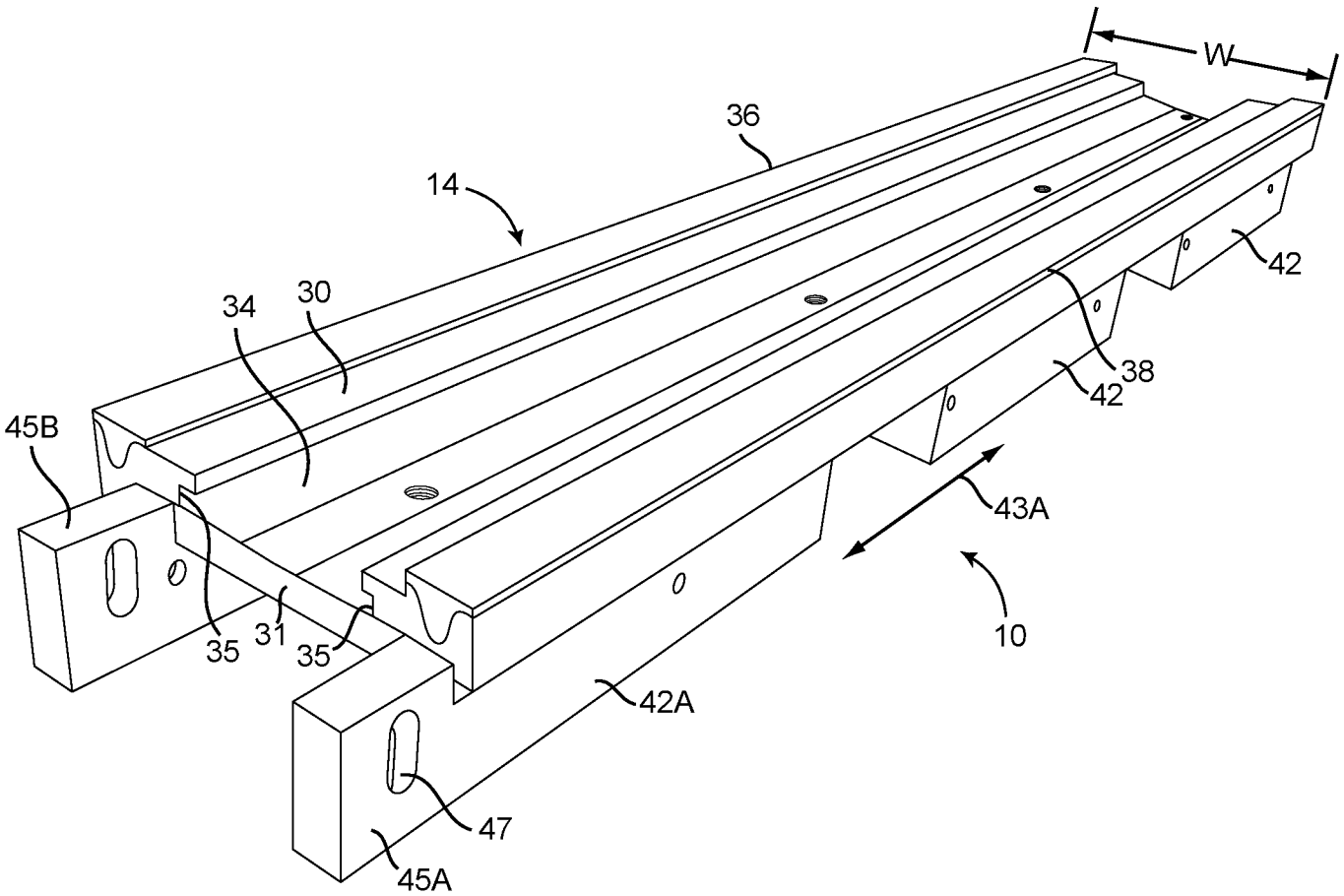
FIG. 2 is a perspective view of an upper assembly of the foil apparatus of FIG. 1.
Figure 3:
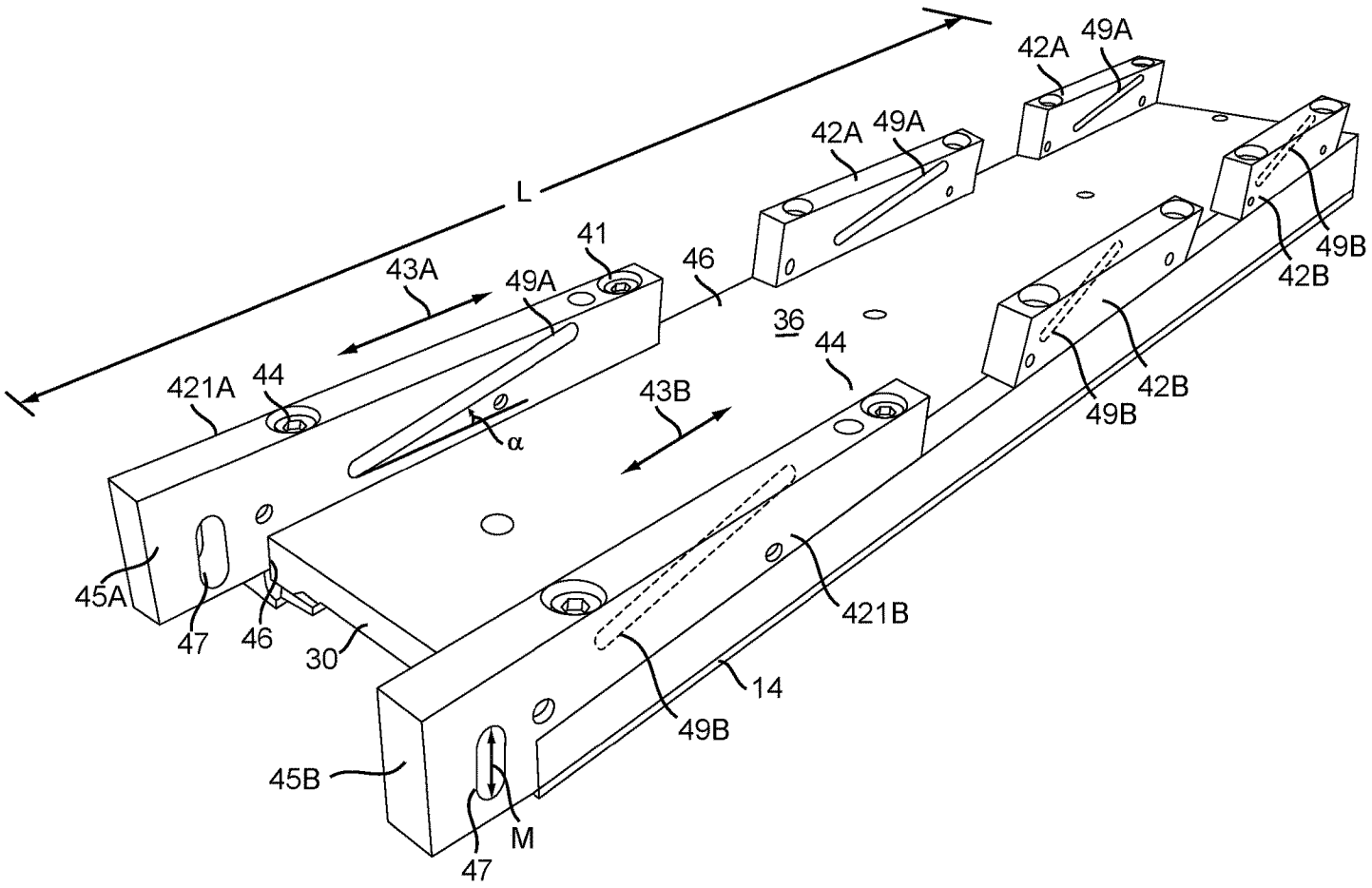
FIG. 3 is an underside perspective view of the upper assembly of FIG. 2.
Figure 4:
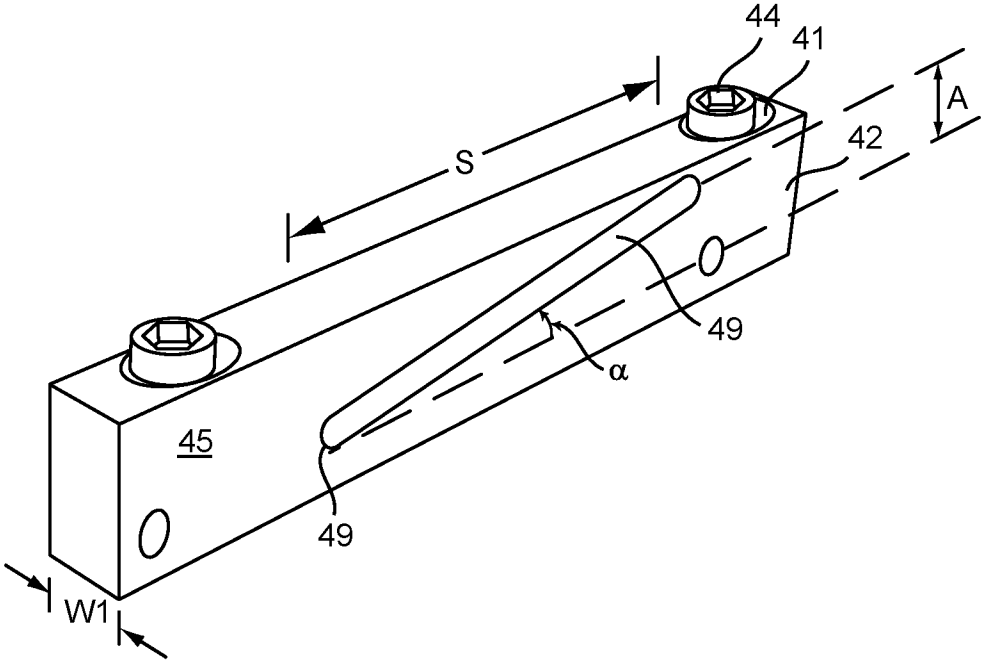
FIG. 4 is a perspective view of an adjustment block of the upper assembly of FIG. 2.

Referring to FIGS. 2-4, the upper assembly 14 includes an elongated upper rail 30 and a forming element 18 removably coupled to the upper rail. In the illustrated embodiment, the forming element 18 is coupled to the upper rail 30 between a leading edge 36 and trailing edge 38 of the foil member 12 which are separately coupled to and removable from the upper rail 30. In other embodiments, the forming element 18 may include the leading edge 36 and trailing edge 38 formed integral with the forming element 18. The forming element 18 including the leading edge 36 and trailing edge 38 thereof typically have a width W in a range of about 2" to about 6" and are made of wear resistant materials such as ceramic. A length of the forming element 18 and leading and trailing edges 36, 38 thereof can range from about 48 inches to about 400 inches depending on the arrangement of the associated paper making machine.

In the illustrated embodiment, the forming element 18 is removable relative to the upper rail 30 for replacing the forming element if worn or damaged and/or switching the forming element with a forming element defining a different working surface 40 (See FIG. 1). Typically, the forming element 18 includes a working surface 40 that defines a cavity or sloped surface designed to create a turbulence in a slurry stock during a dewatering step of a paper making process. Various types of forming elements 18 may be used with a paper making machine depending in part on the features of the machine and/or features or quality of the paper being made.

The upper rail 30 of the present invention defines a cavity 34 for receiving the forming element 18 and removably coupling the forming element 18 to the base 16. As shown in FIG. 2, the upper rail 30 defines a pair of slots 35 extending the length of the upper rail 30 and disposed along each edge thereof for receiving an opposing edge of the forming element 18 in each of the slots 35. Thus, in one embodiment, the forming element 18 may be coupled to the upper rail 30 by sliding the forming element onto the rail with the edges thereof inserted into the slots 35.

Similarly, in the FIG. 2 embodiment, the leading edge 36 and trailing edge 38 are formed separate from the upper rail 30 for removing and replacing these parts individually in the event the edges 36, 38 become worn or if a leading edge 36 or trailing edge 38 of a different design or dimension is desired for a particular paper making process.

Referring to FIGS. 2 and 3, the upper assembly 14 includes a plurality of adjustment blocks 42A, 42B attached to a lower surface 36 of the upper rail 30 via bolts 44 which are affixed to the upper rail through bolt holes 41 defined by the adjustment blocks. In one embodiment, the adjustment blocks 42A, 42B may be disposed in a notch 46 defined by the lower surface 36 of the upper rail 30 and extending throughout a length L of the upper rail along each of the opposing edges 33A, 33B of upper rail. In another embodiment, the upper rail 30 does not have a slot 46, thus the adjustment blocks 42A, 42B are coupled to the lower surface 36 of the upper rail. The adjustment blocks 42A, 42B are arranged end to end and spaced apart in rows 43A, 43B along a length L of the upper rail 30. Thus, the rows 43A, 43B of adjustment blocks 42A, 42B extend along each edge 33A, 33B, respectively of the upper rail 30 throughout the length L of the upper rail. Each of the adjustment blocks 42A in the row 43A is aligned along the length L of the upper rail 30 with a corresponding adjustment block 42B in the row 43B. In one embodiment, the adjustment blocks 42A, 42B have a length in a range of about 2 inches to about 5 inches and are spaced apart in the rows 43A, 43B respectively. The spacing between the adjustment blocks 42A and 42B may be in a range from about 6 inches to about 12 inches. In one embodiment the adjustment blocks 42A, 42B are approximately 4 inches long and the space between the end of each successive block in the rows 43A, 43B is approximately 9 inches. The configuration of the adjustment blocks 42A, 42B spaced apart and extending throughout the entire length L of the foil apparatus 10 provides for precise and accurate spacing of the forming element 18 relative to the forming fabric 20 throughout the length of the forming element.

A lead adjustment block 421A, 421B is attached at a front end 31 of the upper rail 30 in each of the rows 43A, 43B, respectively. Each of the lead adjustment blocks 421A, 421B defines a coupler block 45A, 45B respectively for attaching the upper assembly 14 to the adjustment mechanism 24. The coupler blocks 45A, 45B of each of the lead adjustment blocks 421A, 421B respectively, defines an elongated opening 47 for receiving a yoke pin 88 therein. The elongated openings 47 define a length M arranged generally perpendicular to the length L of the upper rail 30 for allowing movement of the upper assembly 14 relative to the base 16 toward and away a forming fabric 20 of a paper making machine (not shown) and while the yoke pin 88 remains engaged with the coupler blocks 45. In the FIG. 3 embodiment, the openings 47 extend through a width of the coupler blocks 45, however, in other embodiments, the openings 47 may extend only partially through the coupler blocks and define blind end openings.

Referring again to FIG. 3, an inside wall 45 of each of the adjustment blocks 42A, 42B, and the lead adjustment blocks, 421A, 421B, defines an elongated slot 49A, 49B formed along a length thereof and disposed at an angle $\alpha$ relative to the length L of the upper rail 30. The slots 49A defined in each of the adjustment blocks 42A, 421A, in the row 43A are lengthwise aligned with the slots 49B in the corresponding adjustment blocks 42B, 421B in row 43B. Thus, the adjustment blocks 42A and 42B are configured as mirror images relative to the other. Similarly, the lead adjustment block 421A is configured as a mirror image of the lead adjustment block 421B.

In one embodiment of the foil apparatus 10, the angle $\alpha$ of the slots 49A, 49B is in a range of about two degrees to about twenty degrees. In another embodiment, the angle $\alpha$ of the slots 49A, 49B measures from about three degrees to about five degrees relative to the length L of the upper rail 30. In one embodiment, a length S of the slots 49A, 49B is in a range of about 1 inches to about 3 inches. The angle $\alpha$ of the slots 49A, 49B relative to the base and the length thereof determines in part, a range of motion of the upper assembly 14 relative to the base 16 as well as the range of motion of the forming element 18 toward and away from the forming fabric 20 of the paper making machine (not shown). Precise movement of the forming element 18 relative to the forming fabric 20 throughout a length of the forming element is provided by a plurality of the adjustment blocks 42A, 42B disposed in the rows 43A and 43B throughout the length of the upper rail 30.

As shown in the embodiment of FIGS. 3 and 4, the angled slots 49A, 49B defined by the adjustment blocks 42A, 42B, 421A, 421B extend only partially through a width W1 of the adjustment blocks forming closed slots. The slots 49A, 49B are machined as closed slots for reducing or inhibiting an inflow of the stock slurry of a paper making process from entering the slots and interfering with or clogging the adjustability of the upper assembly 14 relative to base 16 of the foil apparatus 10. In other embodiments of the foil apparatus 10, the slots 49 may extend throughout the width W1 of the adjustment blocks 42A, 42B, 421A, 421B.

Figure 5:
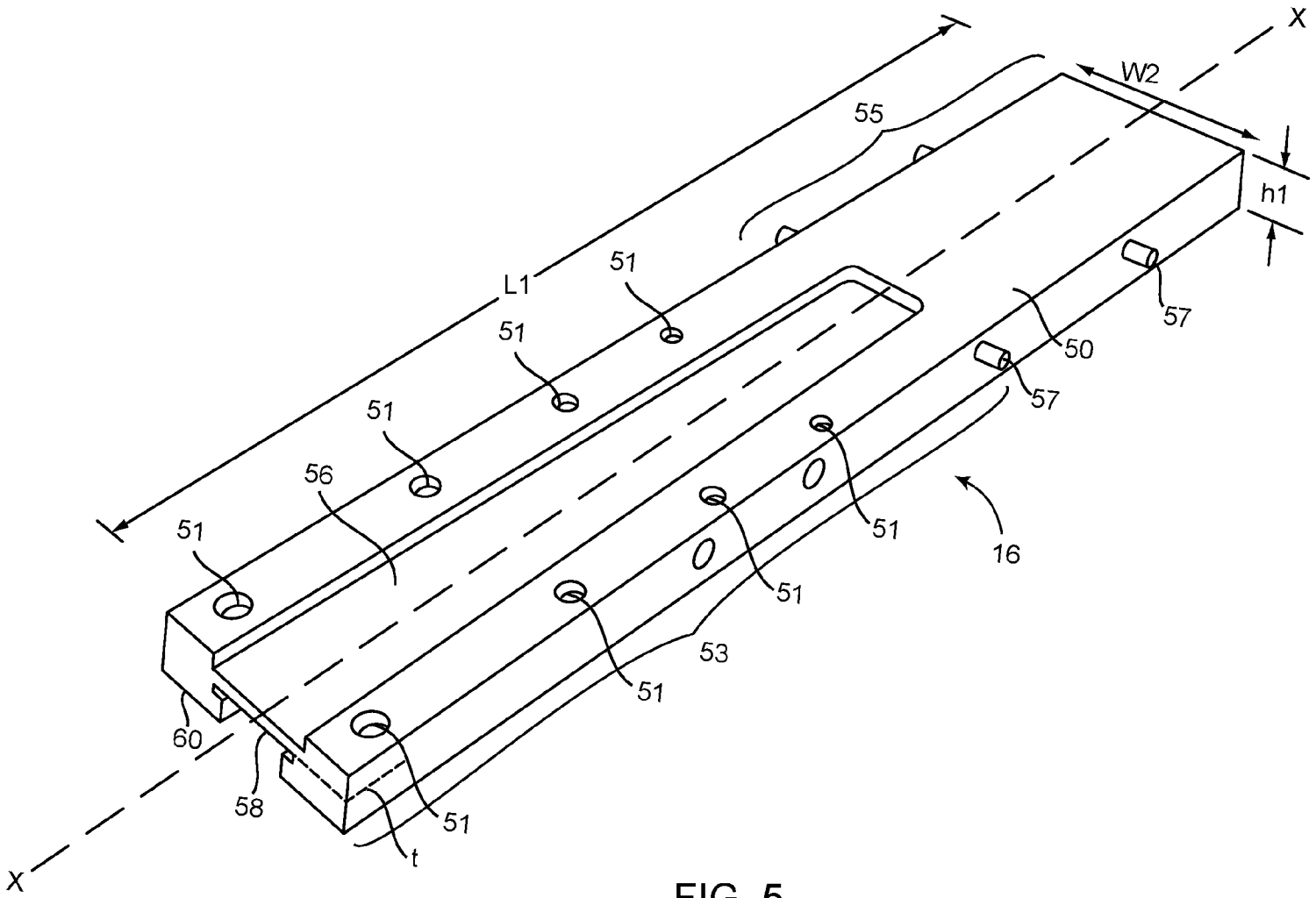
FIG. 5 is a partial perspective view of a base of the foil apparatus of FIG. 1.
Figure 6:
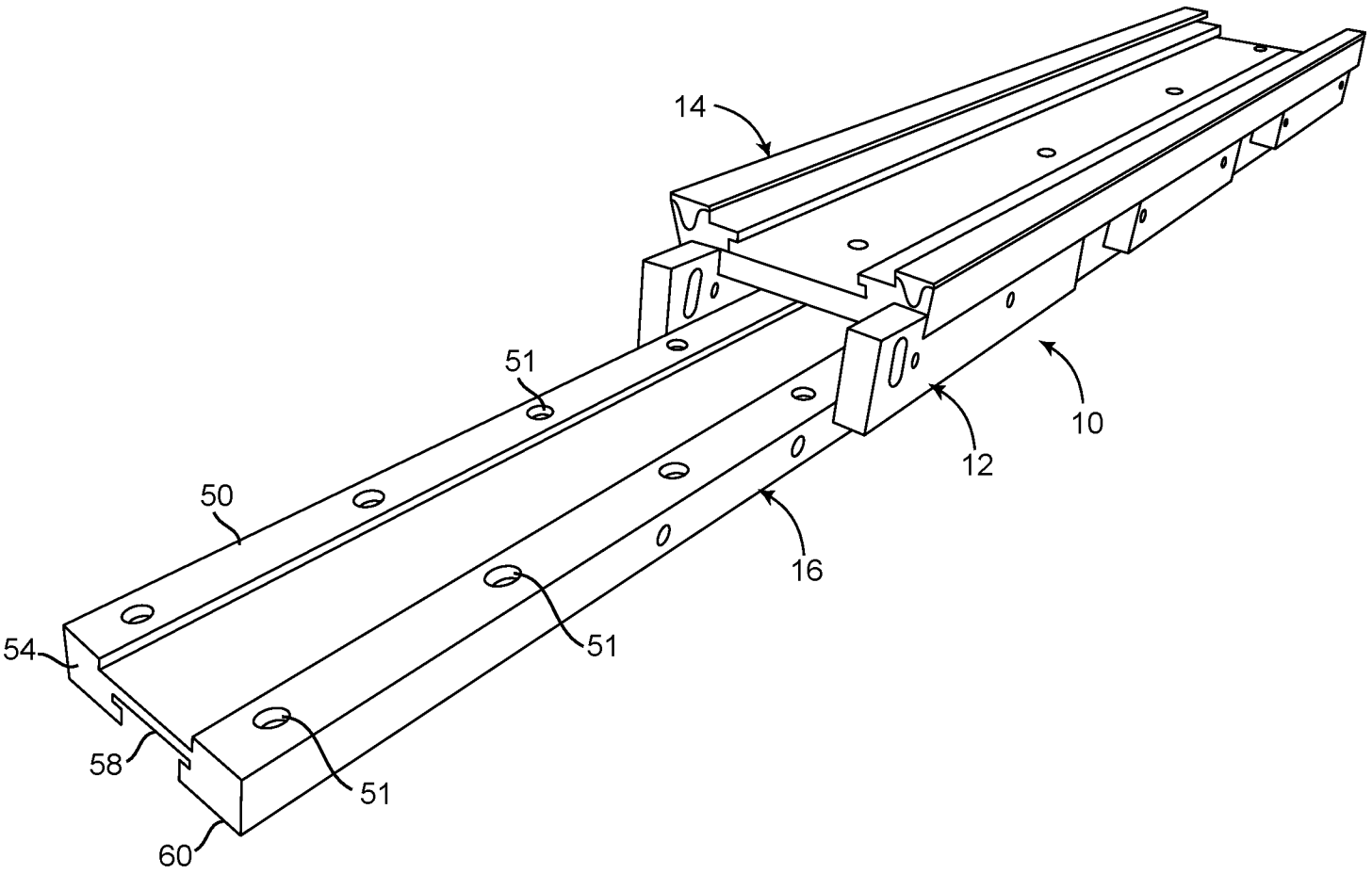
FIG. 6 is a perspective view of the upper assembly and base of the foil apparatus of FIG. 1 with certain parts omitted for clarity.

Referring to FIGS. 5 and 6, the base 16 of the foil apparatus 10 includes an elongated base rail 50 having a length L1 which is longer than the length L of the upper rail 30 and includes a front portion 53 and a rear portion 55. The rear portion 55 of the base rail 50 defines a width W2 and fits between the rows 43A, 43B of adjustment blocks 42A, 42B, 421A, 421B, of the upper assembly 14 as shown in FIG. 6. A plurality of pins 57 extend through the width W2 of the base rail 50 and extend outwardly from the base rail on each side thereof as shown in FIG. 5. The pins 57 are spaced apart along the length L1 of the base rail 50 for alignment, one each, with the slots 49A, 49B of the adjustment blocks 42A, 42B, 421A, 421B. Each of the pins 57 are also aligned one with the other, relative to a height hl of the base rail 50. The pins 57 are fixed to the base rail 50 via press fit, adhesive or other suitable means. In another embodiment (not shown) each of the pins 57 is formed of two half-pins, one each, extending outwardly from the opposing sides 51 of base rail 50. In one embodiment of the foil apparatus 10, the pins 57 have a diameter of 3/16 inches. In other embodiments, the pins 57 can have a diameter in a range from about 3/16 inches to about one-quarter inch.

Still referring to FIGS. 5 and 6, the front portion 53 of the base rail 50 defines a slide opening 56 extending along an entire length of the front portion of the base rail for receiving a slide block 65 therein. In the illustrated embodiment, the slide opening 56 includes a rectangular-shaped recess defined by the base rail 50 and extending throughout a length of the front portion 53. A width W3 of the slide opening is centered about a central axis of X-X of the foil apparatus 10 and is less than the overall width W2 of the base rail 50. A plurality of holes 51 extend through the base rail 50 along the opposing edges of the front portion 53 of the base rail and outside of the slide opening 56. A top of the T-slot 58 is identified with the reference letter t which is discussed herein following.

A lower surface 60 of the base rail 50 defines a T-slot 58 extending throughout the length L1 of the base rail for receiving a T-rail mounted to a paper making machine for mounting the foil apparatus 10 in a dewatering station of a paper making machine (not shown). Thus, the foil apparatus 10 is designed to mount to existing paper making machines configured to support a foil apparatus on a T-rail fixed to the paper making machine. Typically, the foil apparatus 10 is mounted to a paper making machine by fitting the T-slot 58 of the base rail 50, at one end of the base rail over the T-rail mounted to the paper making machine, and sliding the foil apparatus 10 lengthwise along the T-rail so that the entire length of the foil apparatus 10 is engaged with and overlying the T-rail of the paper making machine.

In other embodiments, the base rail 50 may define a dove tail slot or other opening or coupler for mounting the foil apparatus 10 to a paper making machine. In another embodiment of the foil apparatus 10, the base rail 50 may include a flange defining bolt holes for securing the foil apparatus 10 to a paper making machine via bolts or other fasteners.

FIG. 6 shows the upper assembly 14 mounted to the base rail 50 of the base 16. The forming element 18 of the upper assembly 14 is omitted in FIG. 6. Also not visible in FIG. 6, each of the pins 57 extend through the width of the base rail 50 and into the closed slots 49A, 49B of the adjustment blocks 42A, 42B, 421A, 421B for slidably coupling the upper assembly 14 to the base 16 and base rail 50 thereof. Note, as configured in FIG. 6, to mount the upper assembly 14 onto the base 16, at least one of the rows 43A, 43B of the adjustment blocks 42A, 421A, 42B, 421B should be removed from the upper rail 30. In assembly, the through pins 57 of the base 16 and closed slots 49 of the upper assembly 14 provide a durable and substantially sealed adjustable foil member 12 designed for accurate movement of the upper assembly 14 relative to the base 16 and long term use in a paper making machine.

Figure 7:
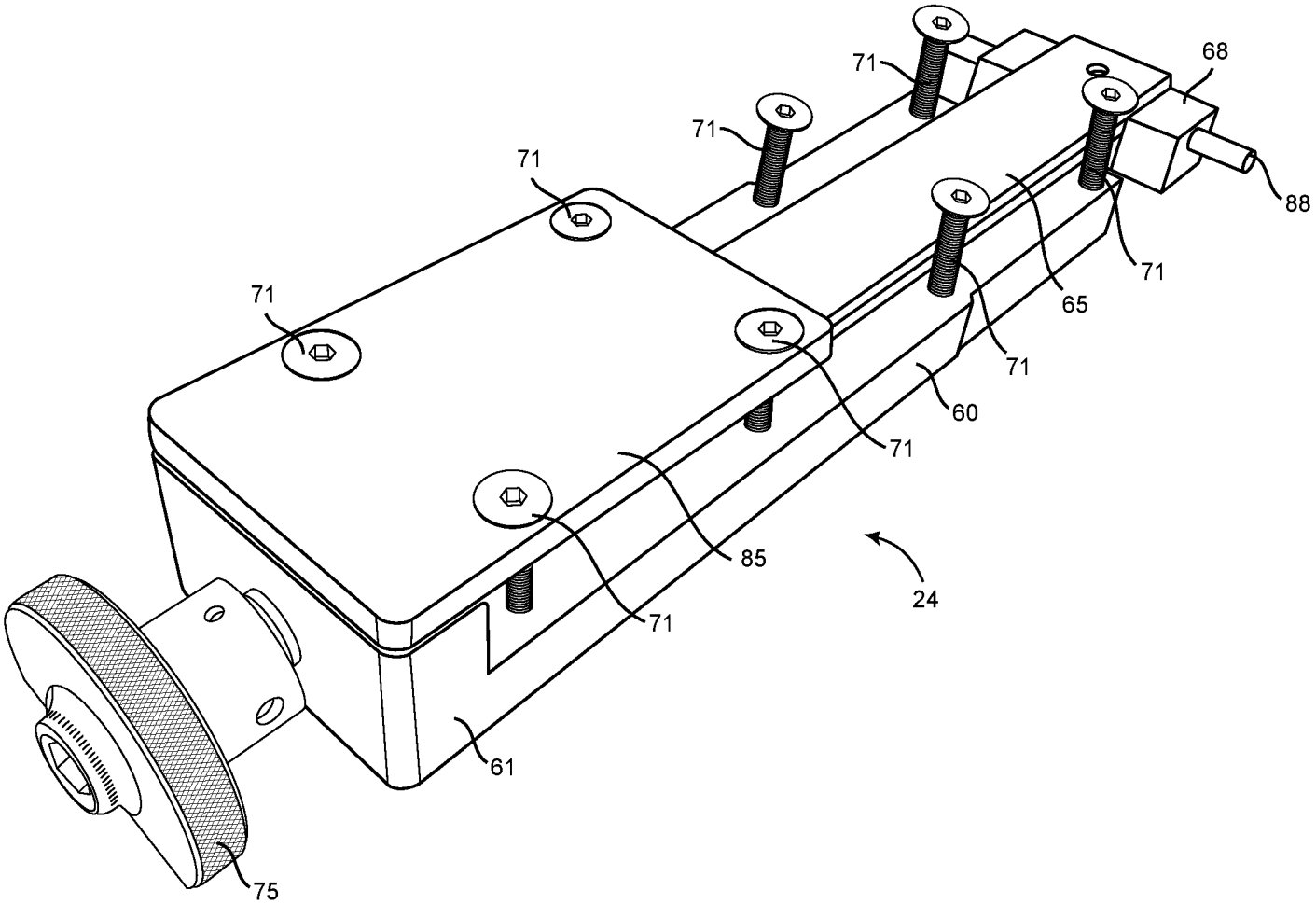
FIGS. 7-9 are various underside perspective views of one embodiment of an adjustment mechanism of the foil apparatus disclosed.
Figure 8:
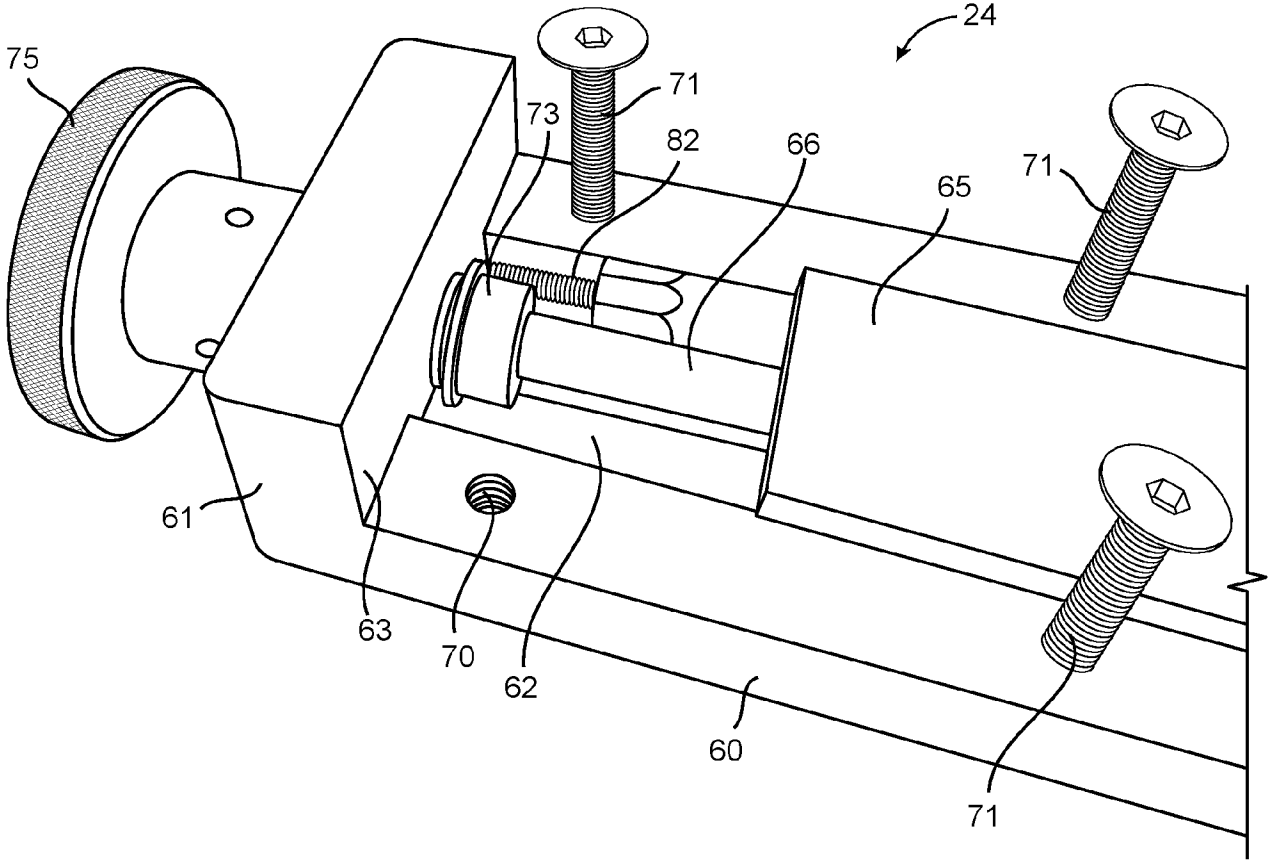
Figure 9:
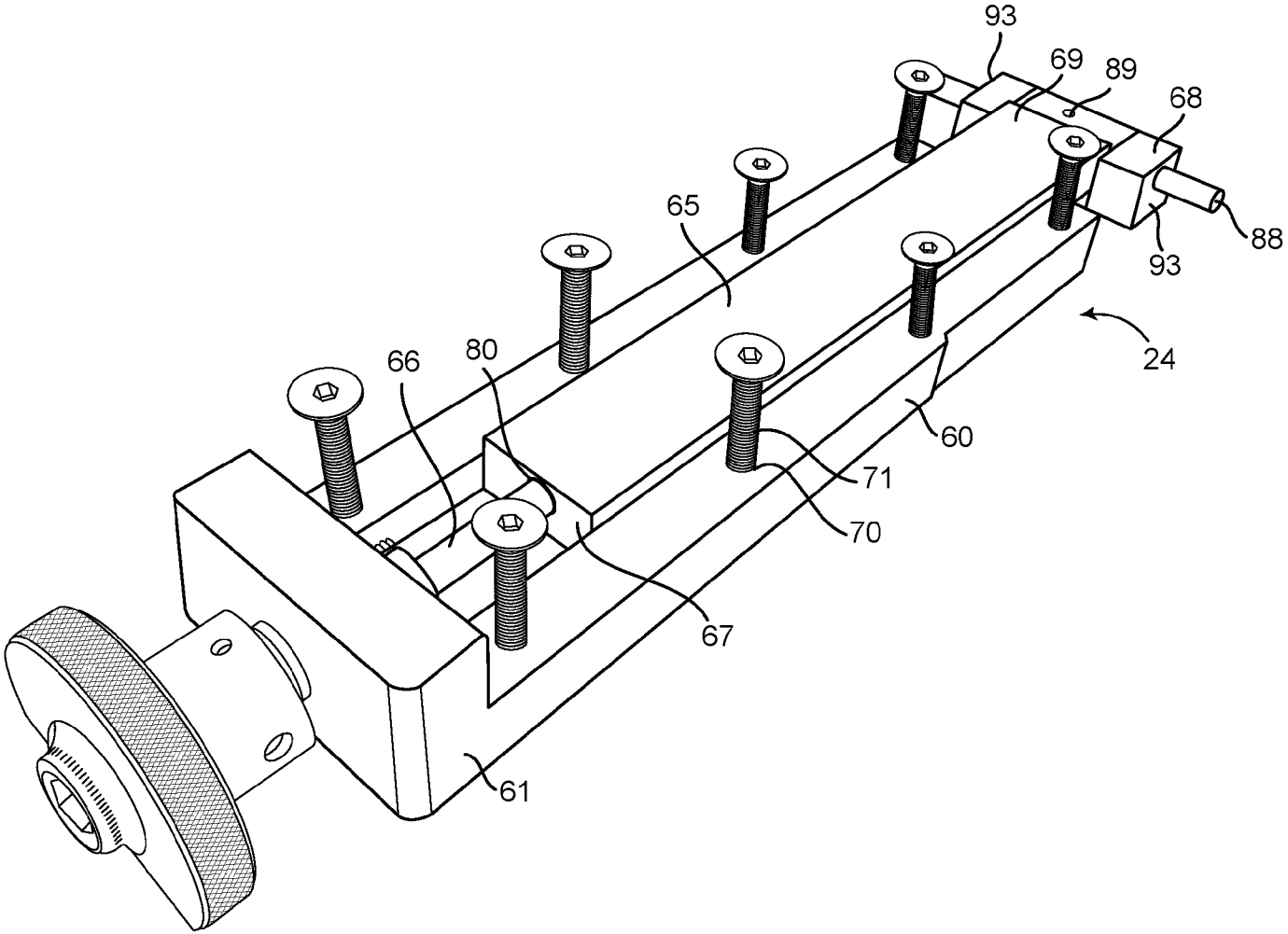

FIGS. 7-9 show a bottom side of embodiments of the adjustment mechanism 24 of the present invention. The adjustment mechanism 24 includes an elongated frame 60 defining a cavity 62 extending substantially through a length of the frame and centered relative to a width of the adjustment mechanism. The frame 60 defines an endpiece 61 at one end thereof. The endpiece 61 defines a surface 63 for abutting an end 54 of the base rail 50 when the adjustment mechanism 24 is mounted to the base 16. (See FIG. 1). The frame 60 defines a plurality of threaded holes 70 for receiving fasteners 71 for attaching the frame 60 to the base rail 50 via the plurality of corresponding holes 51 formed in the base rail 50. As shown in FIGS. 7 and 8, the holes 71 are arranged in rows along the outside edges of the frame 60 and between the edge of the frame and the cavity 62. A slide block 65 is positioned partially in the cavity 62 of the frame 60 and partially in the slide opening 56 of base rail 50 (between the frame 60 and base rail 50) for slideable movement therein relative to the frame 60 and the base rail 50.

Figure 10:
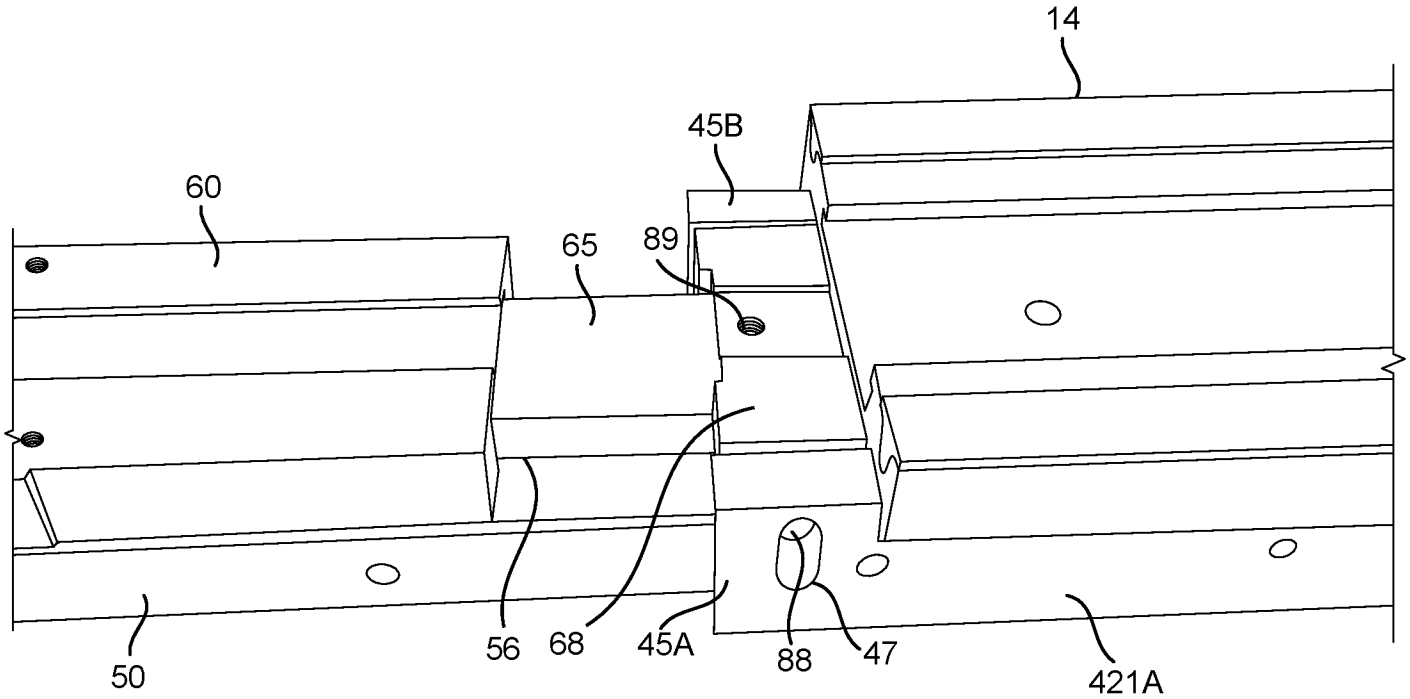
FIGS. 10 and 11 are partial perspective view of the foil apparatus of FIG. 1 showing the adjustment mechanism coupled to the upper assembly of the foil apparatus.

As shown in FIG. 8, an adjustment rod 66 is coupled to the endpiece 61 via a bushing 73 for rotation relative to the endpiece. A first end (not visible in FIG. 8) of the rod 66 extends through the endpiece 61 and is coupled to an adjustment knob 75. One or more set screws (not shown) fix the adjustment knob 75 to the adjustment rod 66. A second end of the rod 66 is threaded, and threadably engaged with the slide block 65 via a threaded hole 80 extending into a first end 67 of the slide block. A yoke 68 is attached to a second end 69 of the slide block 65. The yoke 68 includes a yoke pin 88 fixed to the yoke and extending through the yoke and outwardly from each of opposing ends 93 of the yoke. The yoke pin 88 extends outwardly from the yoke 68 in a direction substantially perpendicular to a length of the rod 66 and movement of the slide block 65 relative to the cavity 62. As shown in FIG. 10, each end of the yoke pin 88 extends into the openings 47 defined by the coupler blocks 45A, 45B. The openings 47 are elongated to allow movement of the yoke pin 88 relative to the coupler blocks 45A, 45B in a direction of the length M of the openings 47 (See FIG. 3) while remaining engaged with the coupler blocks in a direction of the movement of the slide block 65 relative to the cavity 62. In one embodiment, the yoke pin has a diameter of 3/16", however other sizes of yoke pins may be used.

The threaded engagement of the rod 66 with the slide block 65 provides for slideable movement of the slide block 65 and the yoke 68 relative to the frame 60 and toward or away from the endpiece 61 via rotation of the knob 75. Thus, in the illustrated embodiment, rotation of the rod 66 via knob 75, pushes or pulls the slide block along the cavity 62 and relative to the frame 60 depending on the direction of rotation of the knob 75. This causes the yoke 68 to move the upper assembly 14 relative to the base 16 and the adjustment mechanism 24 in a direction of the axis X-X shown in FIG. 5. Thus, turning the knob 75 causes the yoke 68 to push or pull the upper assembly 14 toward or away from the base 16. Accordingly, the lead adjustment blocks 421A, 421B coupled to the yoke 68, as well as the other adjustment blocks 42A, 42B being coupled to the upper rail 30 are thereby moved toward or away from the base 16. This movement causes the slots 49A, 49B in the adjustment blocks (421A, 421B, 42A, 42B) to ride on the pins 57 of base 16 causing the overall height h of the foil assembly 10 to increase as the upper assembly 14 moves away from the adjustment mechanism 24 or decrease when the upper assembly is pulled toward the adjustment mechanism. In other embodiments, depending on the configuration of the rod 66 and slots 49A, 49B, moving the upper assembly 14 away from the adjustment mechanism may result in an increased overall height h of the foil assembly 10. In the illustrated embodiment the overall height h of the foil apparatus 10 (as measured from a lower surface of the base rail 50 to an upper edge of the forming element 18) is adjustable in a range from about 1.5 inches to about 2 inches. In other embodiments the adjustment of the overall height h of the foil apparatus 10 can be in a range from about 0 inches to about one-half inch. In more precision embodiments of foil apparatus 10, the height h of the foil apparatus is adjustable in a range of about 0 inches to about 0.375 inches. The yoke pin 88 is dimensioned to fit snugly within the opening 47 in a direction parallel to the movement of the slide block 65 so that there is no play between the yoke pin 88 and the opening 47 during movement of the slide block.

Due to the configuration of the slots 49A, 49B, wherein the length S of the slots is longer than a vertical displacement of the slot, shown as "A" on FIG. 4, we can determine the distance A using right angle trigonometry as: $\tan \alpha = A/S$. For example, if $\alpha = 5$ degrees, and S=6 inches, then A=0.52 inches. Thus, in this example, the adjustment blocks 42A, 42B, 421A, 421B, and upper assembly 16 move relative to the base 16 approximately 6 inches in the direction of the axis X-X of FIG. 5 while moving approximately 0.52 inches in a perpendicular direction toward or away from a forming fabric 20 of a paper making machine as shown in FIG. 1. Accordingly, depending on the configuration of the rod 66, slide block 65, and the slots 49A, 49B in the adjustment blocks 421A, 421B, 42A, 42B, the adjustment of the overall height h of the foil apparatus 10 can be very precise and accurate. For example, in one preferred embodiment, one rotation (360 degrees) causes the overall height h of the foil apparatus 10 to change 0.1 inches. Thus, in one direction of rotation of the knob 75, one full turn equals an increase in height h of the foil apparatus of 0.1 inches, whereas, one full turn in the opposite direction will reduce the overall height h of the foil apparatus by −0.1 inches.

In one preferred embodiment, the minimum height h of the foil apparatus 10 is substantially equal to a height of a conventional foil member used in a paper making machine so that one or more of the adjustable foil apparatus 10 of the present invention can be used with multiple other conventional foil members at the same time on a paper making machine.

In one embodiment a minimum height of the foil apparatus 10, as measured between the top of the T-slot 58 (identified by reference letter "t" in FIG. 5) and an upper surface of the forming element 18 is about 1.2 inches, which is the same as the height of a conventional two-inch foil apparatus. The maximum height is about 1.6 inches (measured between an upper surface of the forming element 18 and the top, t of the T-slot 58) when the height of the foil apparatus is adjusted to its full height as discussed hereinabove. Thus, in one embodiment, the foil apparatus 10 of the present invention can be used alongside of conventional foil apparatus and match the height of the conventional foil apparatus when the present invention foil apparatus 10 is retracted to a minimum height, or near a minimum height.

As also shown in FIG. 8, a stop screw 82 is threadably coupled to the endpiece 61 and extends outwardly therefrom towards the slide block 65 for engagement with the slide block 65. The stop screw 82 is configured to restrict the slideable movement of the slide block 65 near the endpiece 61 and establish an end of the range of movement of the slide block 65 towards the endpiece. Rotation of the stop screw 82 relative to the endpiece 61 allows for adjusting an end of the range of motion of the slide block 65 relative to the endpiece. Thus, the stop screw 82 also fixes an end point of the movement of the upper assembly 14 relative to the base 16, and in the illustrated embodiment can be used to define a minimum overall height h of the foil apparatus 10.

FIG. 7 shows a cover plate 85 attached to the frame 60 via the fasteners 71 for enclosing an area of the coupling of the rod 66 to the slide block 65 and the bushing 73. The cover plate 85 acts to prevent the slurry stock and/or other materials from contacting the adjustable joint between the rod 66 and the slide block 65 as well as the bushing 73 and interfering with the movement of these parts. Removing the fasteners 71 allows the cover plate 85 to be removed for servicing the underlying parts including the rod 66, slide block 65 and bushing 73.

Figure 11:
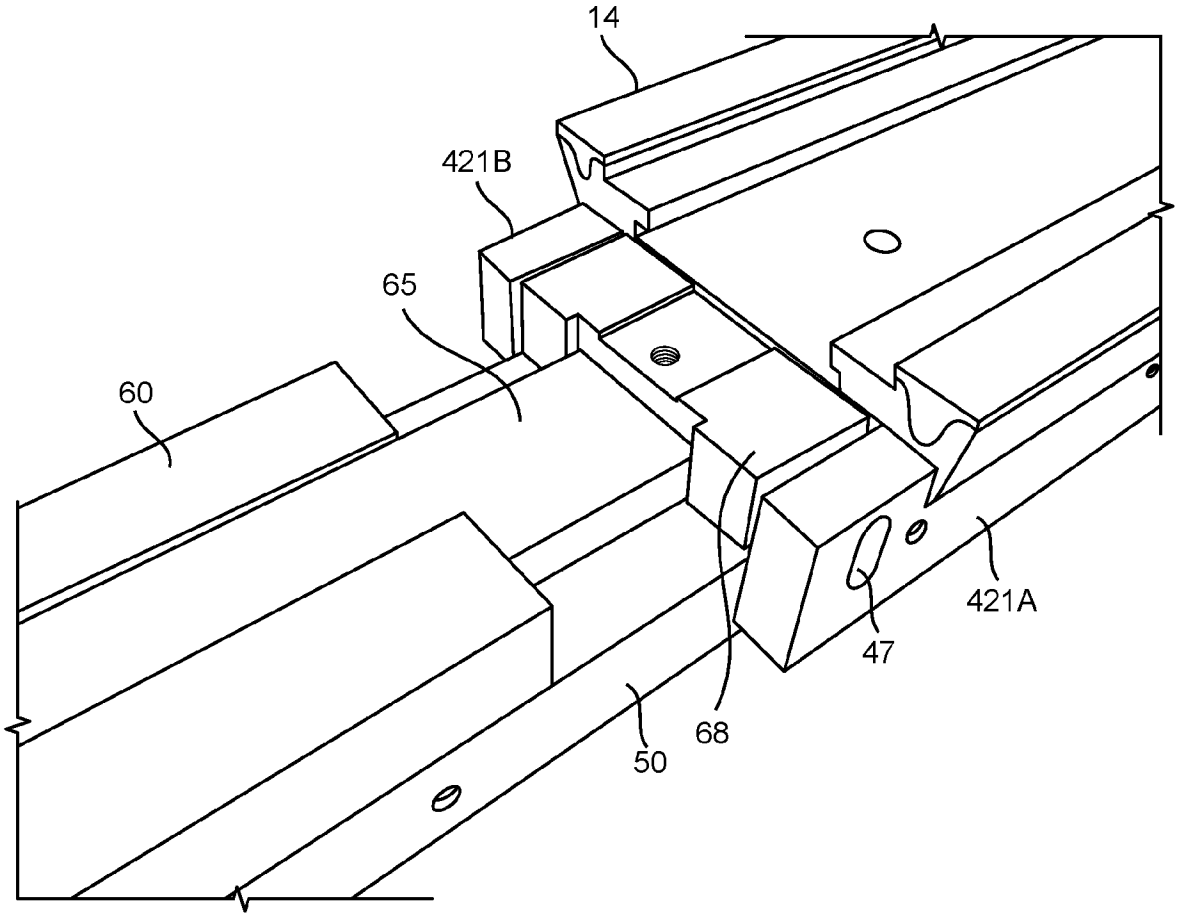

FIGS. 10 and 11 show the adjustment mechanism 24 mounted to the base rail 50 and coupled to the upper assembly 14 via the yoke 68 and the coupler blocks 45A, 45B of the lead adjustment blocks 421A, 421B respectively. As shown, the slide block 65 is disposed in the slide opening 56 of the base rail 50. A threaded hole 89 extending through an upper surface of the yoke 68 is configured to receive a fastener for securing a cover plate 90 (see FIG. 15) over the yoke 68 and a portion of the slide block 65. As discussed above, the cover plate(s) 90 act to prevent slurry stock from interfering with the movement of the component parts of the foil apparatus 10.

Figure 12:
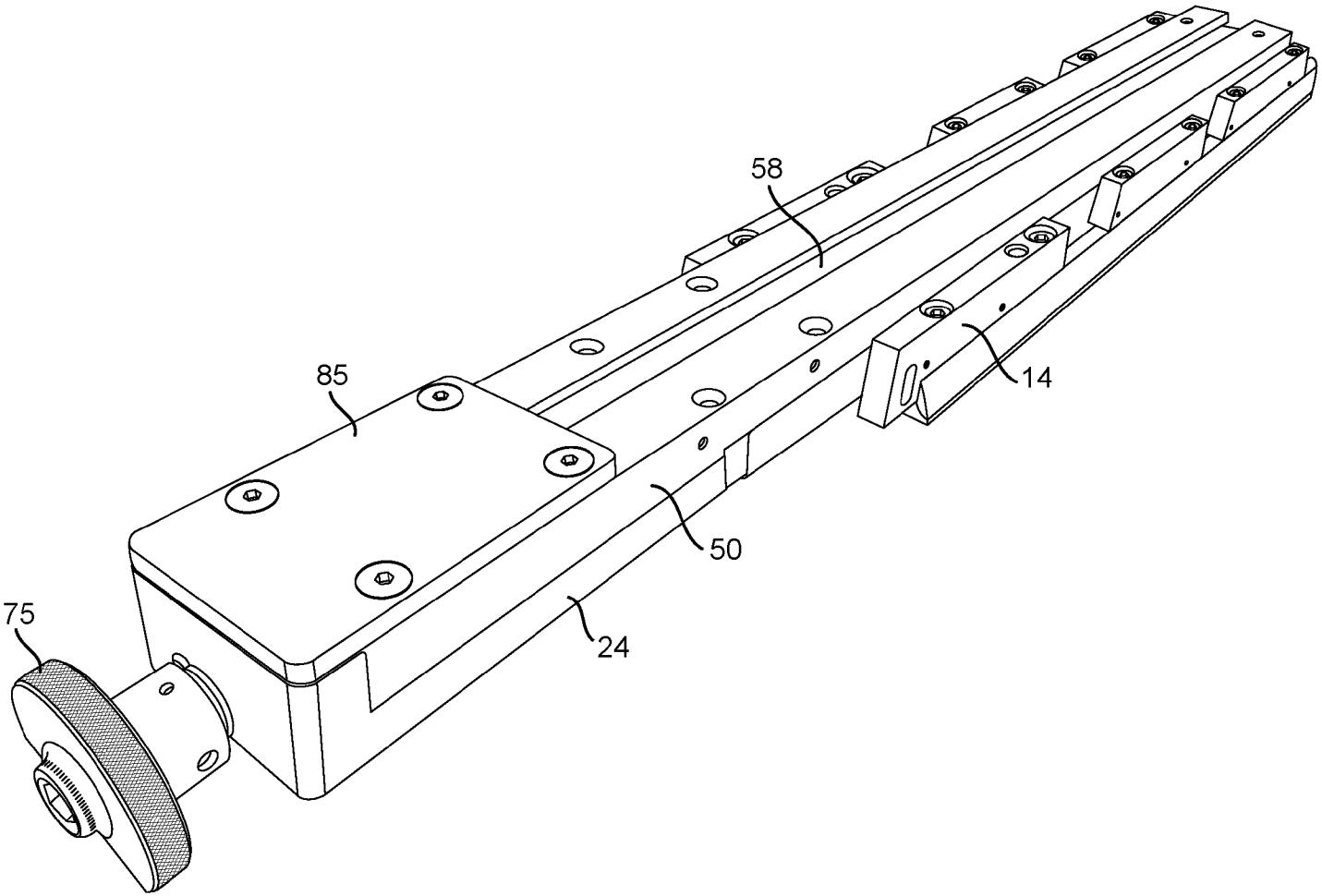
FIG. 12 is an underside perspective view of a fully assembled embodiment of the foil apparatus of FIG. 1.

FIG. 12 shows an underside of one embodiment of a fully assembled foil apparatus 10 of the present invention. Typically, the overall length of the foil apparatus 10 is in a range of about 4 feet to about 40 feet depending on the size and configuration of the paper machine.

Figure 13:
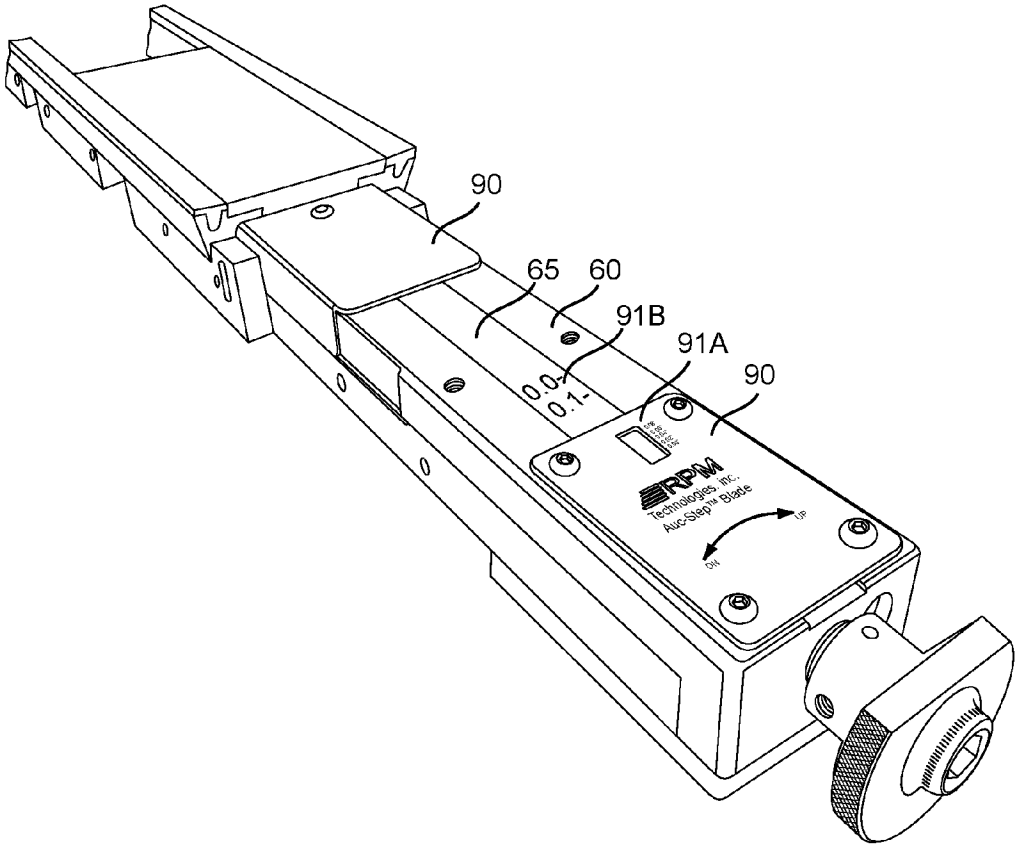
FIGS. 13 and 14 are topside perspective views of the assembled foil apparatus of FIG. 12.
Figure 14:
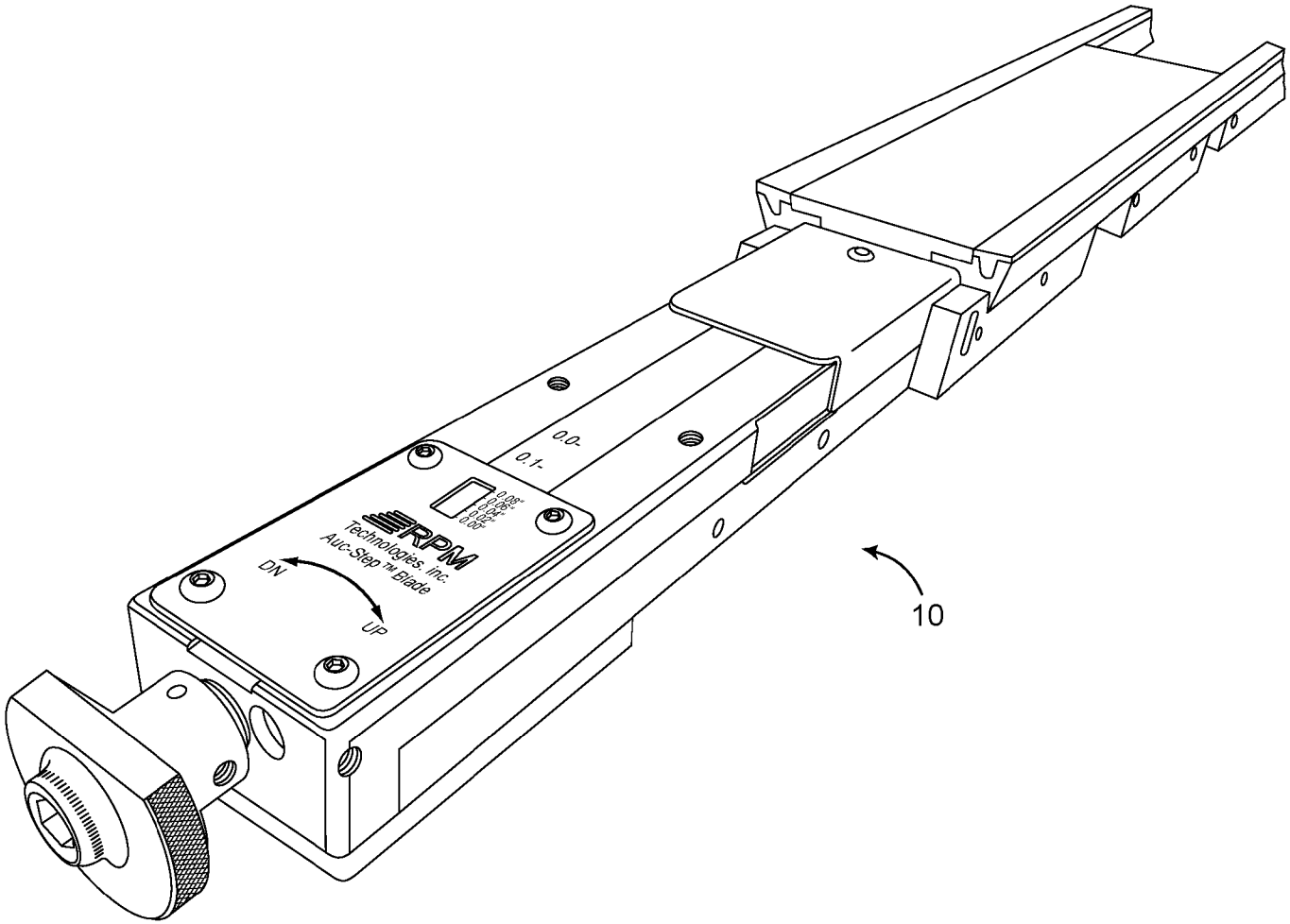

Referring now to FIGS. 13 and 14, the foil apparatus 10 further includes cover plates 90 attached to the frame 60 and/or yoke 68 for covering the couplers and component parts of the adjustment mechanism 24. A scale 91A and 91B are provided on the cover plate 90 and slide bar 65 for identifying the position of the slide bar 65 relative to frame 60. The scale 91A, 91B is used to determine the overall height of the foil apparatus 10 and thereby the position of the forming element 18 relative to a forming fabric of a paper making machine as will be apparent to one skilled in the art.

Figure 15:
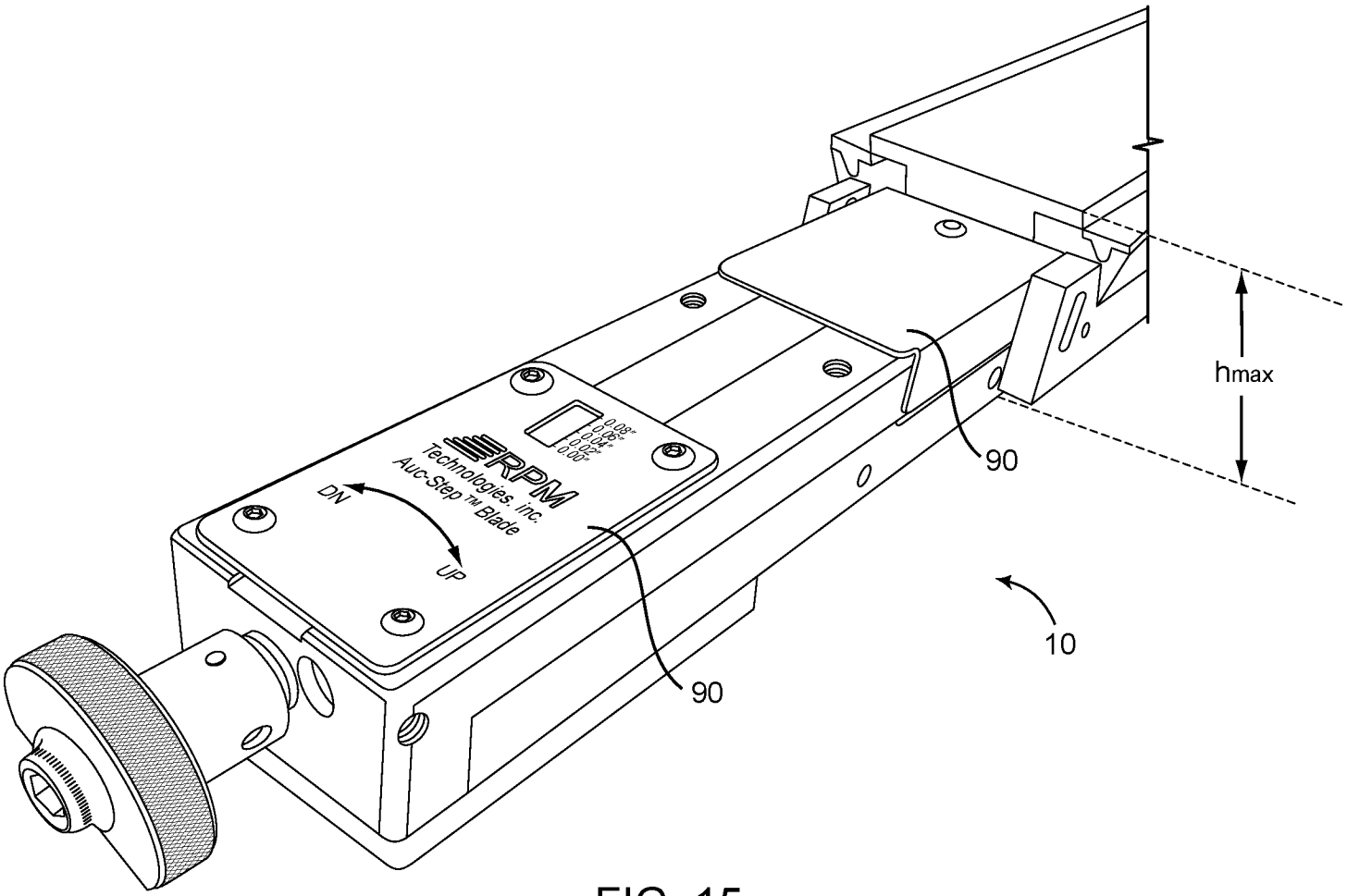
FIGS. 15 and 16 show the foil apparatus of FIG. 12 in each of a "full up" and "full down" position respectively.

FIG. 15 shows the foil apparatus 10 in a full up position wherein the overall height of the foil apparatus including the base 16 and upper assembly 16 is fully extended and at a maximum overall height ($h_{max}$) as measured between the lower surface 60 of the base 16 and an uppermost surface of the forming element 18 and/or leading edge 36 and trailing edge 38 thereof.

Figure 16:
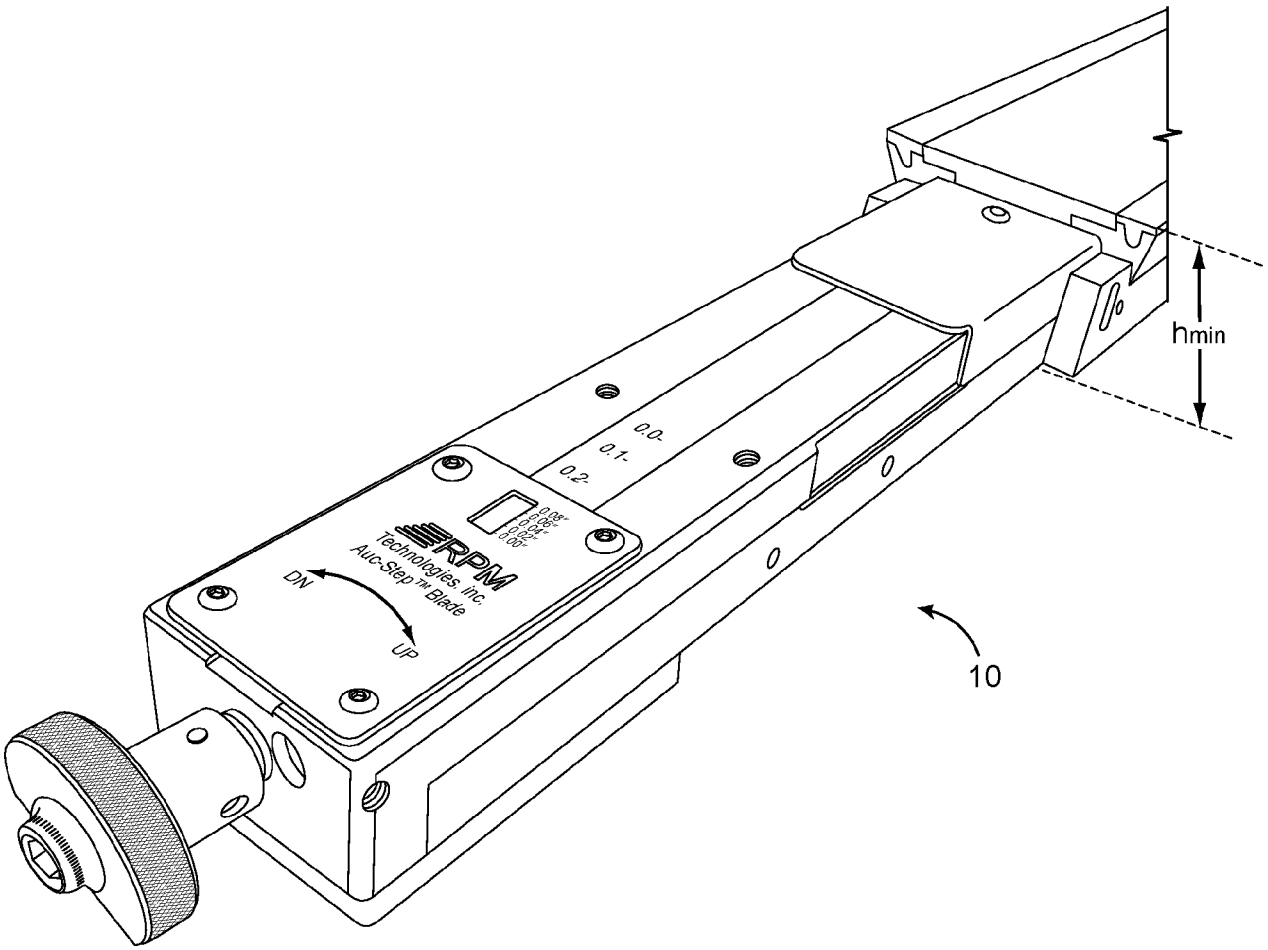

FIG. 16 shows the foil apparatus 10 in a full down position wherein the overall height of the foil apparatus including the base 16 and upper assembly 16 is fully retracted and at a minimum overall height ($h_{min}$) as measured between the lower surface 60 of the base 16 and an uppermost surface of the forming element 18 and/or leading edge 36 and trailing edge 38 thereof.

As used in a paper making machine (not shown) the foil apparatus 10 is mounted on the paper making machine in a dewatering area of the paper making machine. In the illustrated embodiment, the base 16 defines a T-slot for mounting the foil apparatus 10 on the paper making machine by sliding the foil apparatus onto a corresponding T-rail secured to the machine.

The forming element 18 of the foil apparatus 10 is positionable relative to the forming fabric 20 of the paper machine, typically below the forming fabric 20 as shown in FIG. 1.

To enhance and improve the dewatering process and the quality or finish of the paper produced, an overall height h of the foil apparatus is adjustable for moving the forming element 18 toward and away from the forming fabric 20 for adjusting the engagement of the forming element 18 with the forming fabric 20. As set forth above, a height h of the foil apparatus is adjustable between a full down position and a full up positions as shown in FIG. 16 and FIG. 15 respectively for moving the forming element 18 toward and away from the forming fabric 20.

As will be apparent to one skilled in the art, the configuration of the adjustment blocks 421A, 421B, 42A, 42B, and the slots 49A, 49B defined thereby, provides for the raising and lowering of each of the leading edge 36 and trailing edge 38 of the foil member 12 uniformly relative to the forming fabric 20. Thus, the foil apparatus 10 is configured to raise and/or lower the entire foil member 12, vertically towards and away from a side of the forming fabric 20, in a direction substantially perpendicular to the movement of the forming fabric over/under the foil apparatus 10. Thus, both the leading edge 36 and trailing edge 38 of the foil member 12 are raised or lowered together relative to the forming fabric 20 in a precise and uniform manner via rotation of the adjustment knob 75 via an operator (not shown).

In other embodiments (not shown), a step motor or other type of actuator can be coupled to the rod 66 and controlled by a processor to automatically adjust the overall height h of the foil apparatus 10, as will be apparent to one skilled in the art.

Example embodiments and methods thus being described, it will be appreciated by one skilled in the art that example embodiments and example methods may be varied through routine experimentation and without further inventive activity. For example, while the disclosure describes foil apparatus useable with a paper making machine, internal spacing elements or other intermediate elements and/or variations of the disclosed embodiments may be used in connection with the foil apparatus described herein and achieve the same functions as disclosed herein. Variations are not to be regarded as departure from the spirit and scope of the exemplary embodiments, and all such modifications as would be obvious to one skilled in the art are intended to be included within the scope of the following claims.

What is claimed is:

1. An adjustable foil apparatus for a paper making machine comprising:

an elongated upper assembly including a forming element positionable relative to a forming fabric of a paper making machine;

an elongated base mountable to a paper making machine;

the upper assembly being coupled to the base and movable relative thereto, for adjusting an overall height of the foil apparatus, the forming element being configured for selective movement toward and away from the forming fabric of the paper making machine;

an adjustment mechanism having a yoke movable relative to the base along an axis of the base while positioned adjacent an end of the upper assembly;

a first pin and an opposing second pin, each of which is mounted to and extends outwardly from the base; and an elongated first slot and an opposing elongated second slot, each of which is defined by the upper assembly, and movable therewith, and is configured to receive a corresponding one of the first pin and the second pin, wherein each of the first slot and the second slot exhibits an angle inclined with respect to the axis of the base;

wherein the upper assembly is configured to move along a path corresponding to travel of the first slot about the first pin and the second slot about the second pin such that movement of the yoke along the axis of the base, while positioned adjacent the end of the upper assembly, urges the forming element to move relative to the base and toward and away from the forming fabric.

2. The adjustable foil apparatus of claim 1 wherein the forming element further comprises each of a leading edge and a trailing edge, the movement of the forming element including moving each of the leading and trailing edges of the forming element together and uniformly toward and away from the base.

3. The adjustable foil apparatus of claim 1 wherein:

the apparatus further comprises a plurality of adjustment blocks fixed to the upper assembly and configured for selective and slideable movement relative to the base along the axis of the base; and each of the first slot and the second slot is defined in a corresponding one of the plurality of adjustment blocks.

4. The adjustable foil apparatus according to claim 3 wherein the upper assembly further comprises an upper rail to which the plurality of adjustment blocks are coupled, the plurality of adjustment blocks being arranged in first and second rows, each row extending substantially throughout a length of the upper rail, each of the blocks in the first row being aligned along the length of the upper rail with a corresponding one of the adjustment blocks in the second row.

5. The adjustable foil apparatus according to claim 3 wherein each of the plurality of adjustment blocks defines corresponding slot disposed at an angle $\alpha$ relative the length of the upper rail, the angle $\alpha$ being in a range of about three degrees to about five degrees.

6. The adjustable foil apparatus according to claim 3 wherein each of the plurality of adjustment blocks has a length between about two inches and about six inches.

7. The adjustable foil apparatus according to claim 1 wherein the base defines a T-slot for mounting the foil apparatus to a paper making machine, the foil apparatus being selectively movable between a full up and a full down position, in the full down position, a distance between a top surface of the T-slot and an upper edge of the forming element is less than or equal to about 1.2 inches.

8. The adjustable foil apparatus according to claim 7 wherein a difference in an overall height of the foil apparatus between the full up and full down positions is in a range of about 0.3 inches to about 0.5 inches.

9. The adjustable foil apparatus according to claim 1 wherein a range of motion of the forming element is in a range between about 0.30 inches to about 0.5 inches, in a direction generally perpendicular to a length of the foil apparatus, and toward and away from the base.

10. The adjustable foil apparatus according to claim 1 wherein the adjustment mechanism further comprises an adjustment knob, the adjustment mechanism being configured such that one full turn of the adjustment knob raises or lowers the forming element approximately 0.1 inches, depending on the direction of rotation.

11. The adjustable foil apparatus according to claim 1 wherein:

the upper assembly further comprises a first coupler block and a second coupler block, each of which extends outwardly beyond the end of the upper assembly and engages the yoke such that at least a portion of the yoke is positioned between the first coupler block and the second coupler block.

12. The adjustable foil apparatus according to claim 11, wherein:

the first coupler block defines a first elongated opening and the second coupler block defines a second elongated opening; and the yoke has a first yoke pin received by the first elongated opening and a second yoke pin received by the second elongated opening such that the yoke transmits force to the upper assembly via movement of the yoke along the axis of the base while the first coupler block and the second coupler block are moveable, relative to the yoke, in a direction generally perpendicular to the axis of the base.

13. The adjustable foil apparatus according to claim 1 wherein the yoke is configured to allow movement of the upper assembly in a direction of movement of the forming element toward and away from a forming fabric of a paper making machine during selective movement of the upper assembly relative to the base, a first component of the movement being along the axis of the base and a second component of the movement being generally perpendicular thereto, in response to movement of the adjustment mechanism along the axis of the base.

14. The adjustable foil apparatus according to claim 1 wherein each of the first slot and the second slot is disposed at an angle $\alpha$ relative the length of the upper rail, the angle $\alpha$ being in a range of about two degrees to about twenty degrees.

* * * * *